US006742636B2

(12) United States Patent
Godshaw

(10) Patent No.: US 6,742,636 B2
(45) Date of Patent: Jun. 1, 2004

(54) MESH EXPANSION POCKET FOR LUGGAGE

(75) Inventor: Donald E. Godshaw, Evanston, IL (US)

(73) Assignee: Travel Caddy, Inc., Des Plaines, IL (US)

( * ) Notice: Subject to any disclaimer, the term of this patent is extended or adjusted under 35 U.S.C. 154(b) by 0 days.

(21) Appl. No.: 09/963,947

(22) Filed: Sep. 25, 2001

(65) Prior Publication Data

US 2002/0195304 A1 Dec. 26, 2002

Related U.S. Application Data

(60) Provisional application No. 60/235,130, filed on Sep. 25, 2000.

(51) Int. Cl.[7] ..... A45C 3/00

(52) U.S. Cl. ..... 190/111; 190/109; 190/102

(58) Field of Search ..... 190/109, 18 A, 190/111, 102; 150/112, 114, 116, 117; 224/148.1

(56) References Cited

U.S. PATENT DOCUMENTS

| | | | | | |
|---|---|---|---|---|---|
| 2,238,213 | A | * | 4/1941 | Demerer | 150/117 |
| 2,562,499 | A | * | 7/1951 | Lifton | 190/111 X |
| 3,122,225 | A | * | 2/1964 | Ward | 190/107 X |
| 5,105,919 | A | * | 4/1992 | Bomes et al. | 190/190 X |
| 5,497,919 | A | * | 3/1996 | Klinger | 190/109 X |
| 6,328,146 | B1 | | 12/2001 | Siwak | |

* cited by examiner

*Primary Examiner*—Tri M. Mai
(74) *Attorney, Agent, or Firm*—Banner & Witcoff, Ltd.

(57) ABSTRACT

Expansion or collapsible pockets are incorporated in a side panel of luggage for carrying items which require ease of access.

4 Claims, 3 Drawing Sheets

FIG. 4
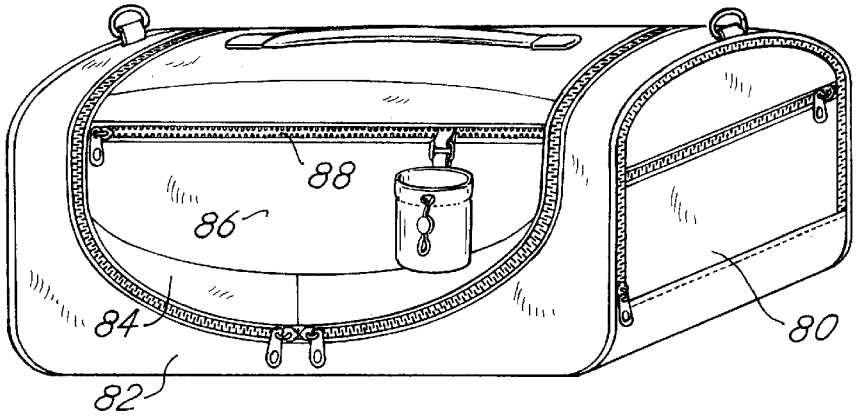
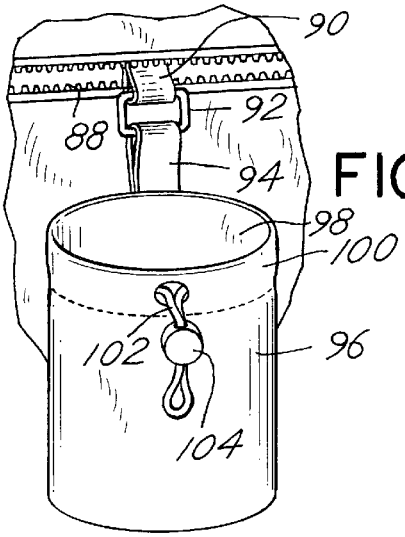
FIG. 6
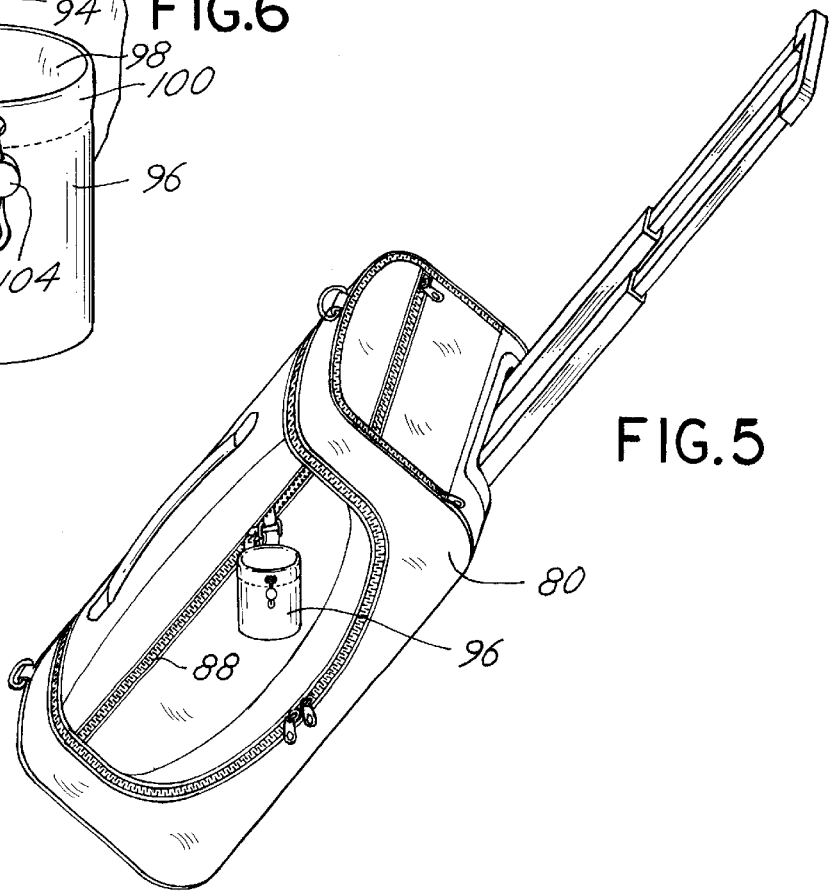
FIG. 5

MESH EXPANSION POCKET FOR LUGGAGE

CROSS REFERENCE TO RELATED APPLICATION

This is a utility application based upon prior provisional application 60/235,130 filed Sep. 25, 2000 entitled Mesh Expansion Pocket for Luggage which is incorporated herewith by reference and for which priority is claimed.

BACKGROUND OF THE INVENTION

In a principal aspect the present invention relates to flexible, expandable pocket constructions for luggage and, more particularly, to a mesh expansion pocket and an expansion pocket which may be retained within a storage pouch of luggage.

Travelers often desire to store items which require prompt access in pouches or pockets incorporated on the outside panels of luggage. For example, beverages, food, cell phones, writing instruments and other items are candidates for storage in such situations. The reason such storage options are deemed desirable is to permit ease of inspection of such items without opening luggage and ease of access to the items in external pockets in order to facilitate use of such items. Thus there has developed a need for improved alternative constructions wherein external pockets or pouches are incorporated on one or more panels of luggage items.

SUMMARY OF THE INVENTION

Briefly, the present invention comprises, in a first embodiment, a luggage item with an expansion pocket attached to a side panel of a case. The pocket includes a mesh panel which connects first and/or second spaced side panels that may be joined by a zipper to each other or the case. The mesh panel further includes a flexible ribbon member along its open top edge which is preferable elastomeric so as to control the size of the pocket. A second or alternative embodiment includes a collapsible pocket which is connected by a strap and a ring member to the inside of a pouch on the side panel of luggage. The collapsible pocket may be removed from the pouch and oriented in any desired fashion by virtue of the ring member which is attached to the strap. The collapsible pocket or bag maintains a proper orientation for transport of goods, such as a water bottle, or the like.

Thus it is an object of the invention to provide an improved pocket construction for mounting on external panels of luggage and the like.

It is a further object of the invention to provide a pocket construction for mounting on the side of a luggage item wherein the pocket includes a mesh expansion feature.

Another object of the invention is to provide a storage pocket which may be collapsed and stored within a pouch on the side of a panel of luggage and which is removable from the pouch in a manner which provides for upright orientation of the contents of the pocket regardless of the orientation of the luggage item.

Yet a further object of the invention is to provide pocket constructions which are economical, easy to incorporate in existing luggage items, compact and easy to use.

These and other objects, advantages, and features of the invention will be set forth in the detailed description which follows:

BRIEF DESCRIPTION OF THE DRAWING

In the detailed description which follows, reference will be made to the drawing comprised of the following figure:

FIG. 4 is an isometric view of an alternative embodiment of a collapsible pocket which is incorporated in a pouch affixed to a side panel of an item of luggage depicting the storage pocket removed from the pouch;

FIG. 5 is an isometric view of the luggage item of FIG. 4 wherein the collapsible pocket is depicted as maintaining a desired orientation relative to the orientation of the associated luggage; and FIG. 6 is an enlarged isometric view of the pocket container construction incorporated in the luggage of FIGS. 4 and 5.

DESCRIPTION OF THE PREFERRED EMBODIMENT

Figure 1:
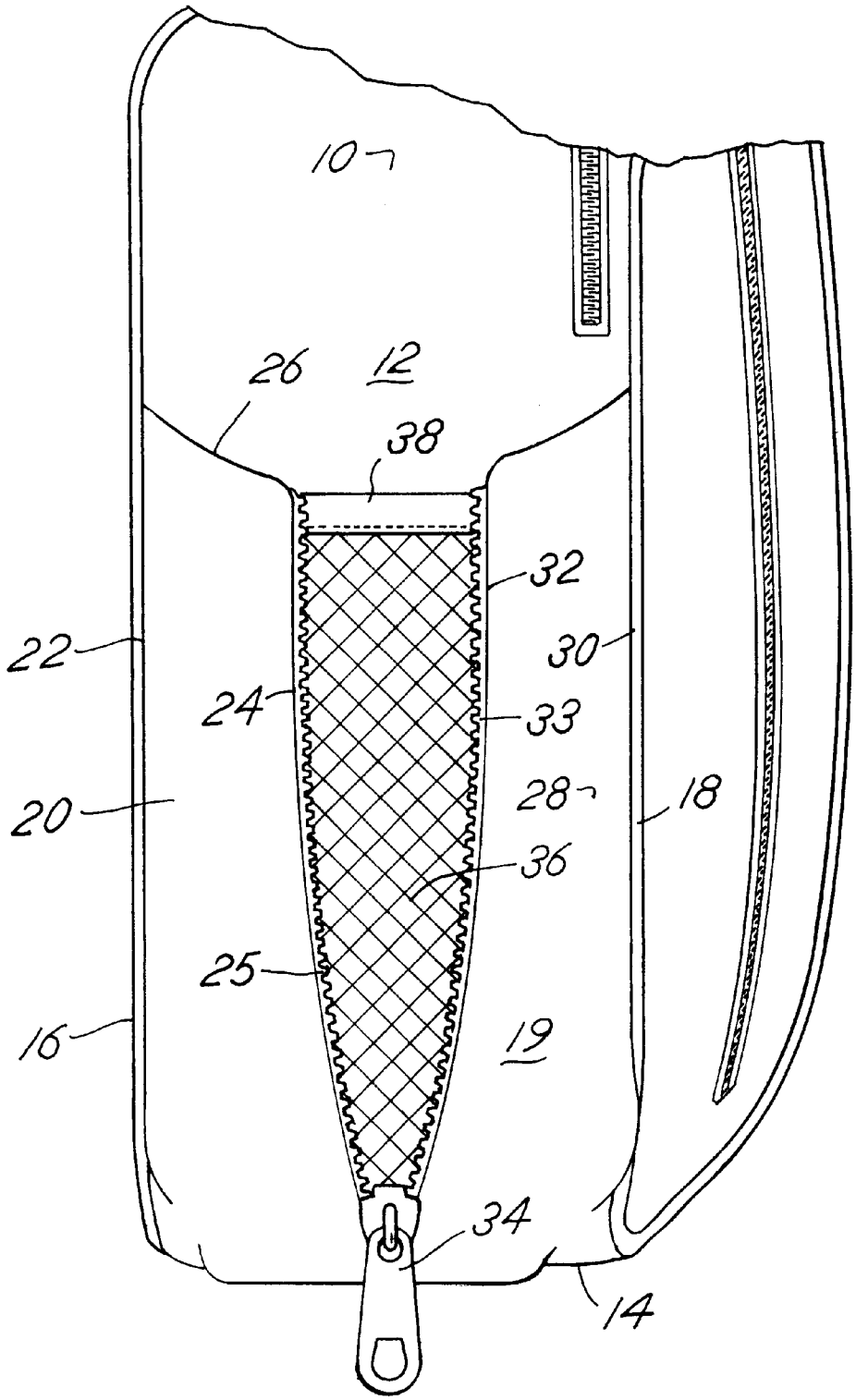
FIG. 1 is an isometric view of a preferred embodiment of the invention.

Referring to the figure, the subject matter of the invention relates to a luggage item, and more particularly, a luggage item such as a soft-sided backpack or carrying case 10 having a side panel 12. The side panel 12 is typically made of flexible material such as fabric, leather, canvas, or the like. The side panel 12 includes a lower edge 14, a first side edge 16 extending upwardly from the lower edge 14 and a second upwardly extending side edge 18 generally parallel to and spaced from the first side edge 16. The flexible side panel 12 is thus framed by the lower edge 14 and the first and second side edges 16 and 18.

The side panel 12 includes an expansion pocket 19 affixed or stitched thereto. The expansion pocket 19 includes a first flexible material panel 20 which is attached along a lower edge thereof to the lower edge 14. Panel 20 is attached along one side 22 to the first side edge 16. Opposite side 24 of panel 20 includes a fastening mechanism, and more particularly, a zipper 25. A top edge 26 is arcuately configured and spaced upwardly from the bottom edge 14.

A second panel 28 is generally a mirror image of the first panel 20 and includes a lower edge connected to the lower edge 14 of the case or container 10 and a side edge 30 connected to the second side edge 18. An inside edge 32 of the second panel 28 includes a fastening mechanism which again comprises a zipper 33. Thus, a zipper tab or control 34 may be utilized to close the opening defined between the edges 24 and 32 of the panels 20 and 28 to thereby form an enclosed pocket.

Attached on the inside surface of each of the respective panels 20 and 28 and connected there between is a mesh panel 36. The mesh panel 36 is flexible and a flexible connecting band or ribbon 38 is provided at the upper end or margin of the panel 36. The ribbon 38 connects between the inside surfaces of the first panel 20 and second panel 28 to limit the extent of opening of the panels 20 and 28 and also forms the upper edge of the mesh 36 to prevent the mesh from becoming frayed. The mesh 36 and ribbon 38 co-jointly limit the amount of opening or expansion of the first panel 20 and second panel 28 one from the other. The pocket 19 is designed to hold, for example, a water bottle, cell phone, or other item, by placing the item within the pocket 19 and by expanding the pocket by unzipping the zipper mechanism so as to be in the open position as depicted. Thereafter, the zipper control 34 may be closed when not encompassing an item, or partially closed to secure the item in place.

Among the important features of the invention is the mesh 36 retained on the inside of the panels 20 and 28, the utilization of a ribbon 38 to control the expansion of pocket 19, and the extension of the zipper mechanism from adjacent the lower edge 14 for the entire length of the panels 20 and 28.

Figure 2:
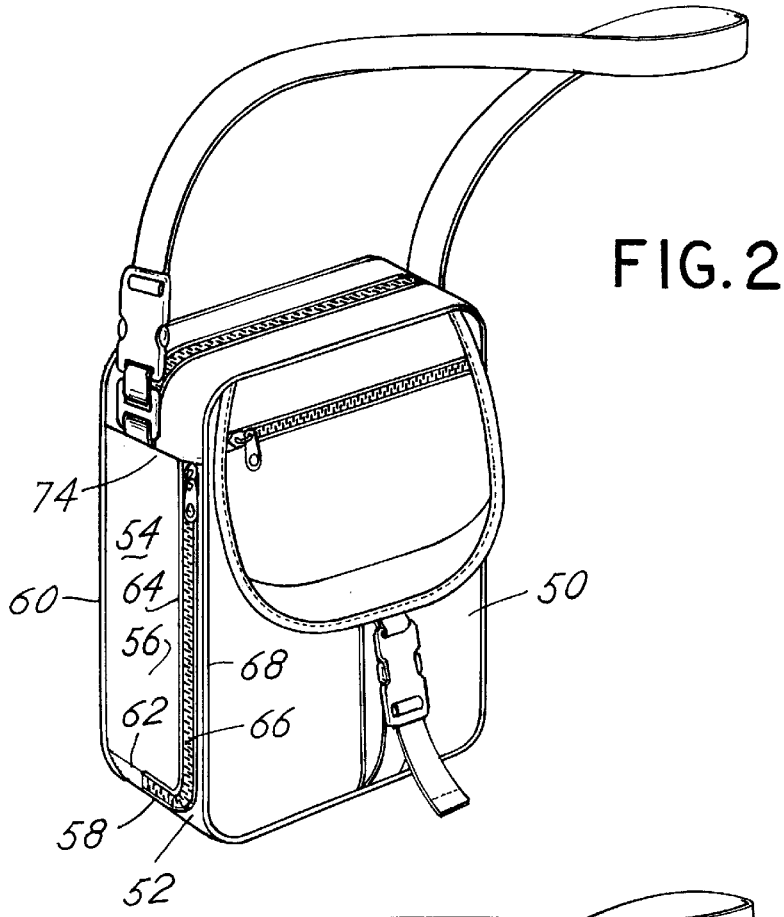
FIG. 2 is an isometric view of a typical case or luggage item incorporating an expansion pocket.
Figure 3:
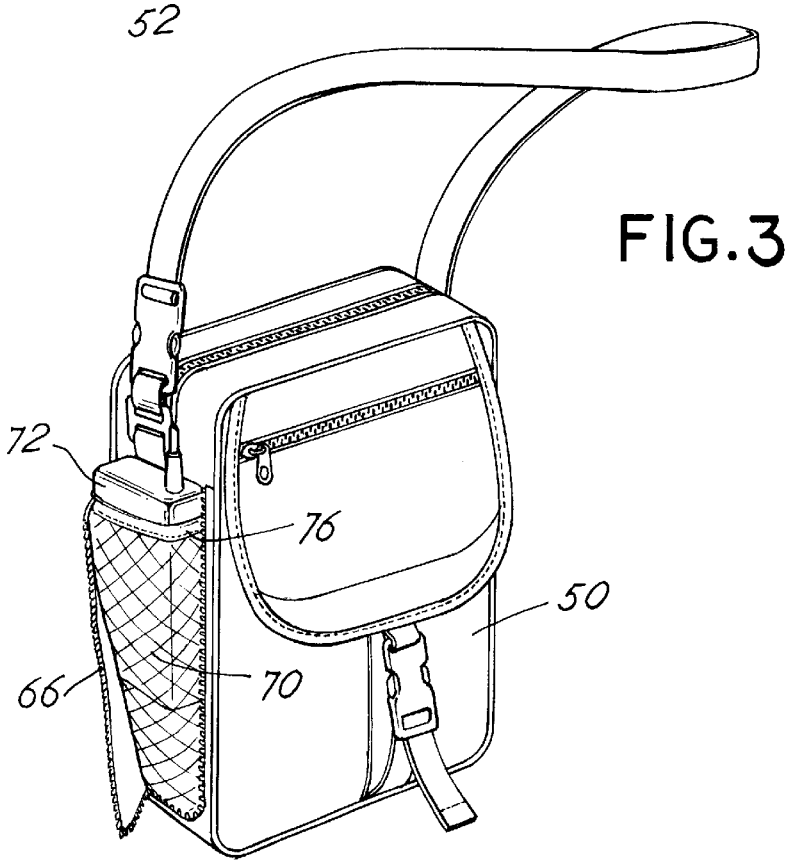
FIG. 3 is an isometric view of the expansion pocket of FIG. 2 wherein the pocket has been released and opened so as to permit the insertion of an item such as a cell phone.

FIGS. 2 and 3 illustrate a modification of the expansion pocket of FIG. 1. Referring to FIGS. 2 and 3 there is depicted a carrying case 50 which includes a side panel 52 to which an expansion pocket 54 is incorporated. The expansion pocket 54 includes a flexible fabric, elongate panel 56 which extends from a bottom edge 58 of the case 50 upwardly along the side panel 52. The flexible panel 56 is comprised of a fabric material or leather and is stitched along a side 60 to the case 50. A lower edge 62 of the panel 56 and opposite side edge 64 of the panel 56 are attached by a zipper 66 to the bottom edge 58 and side edge 68 of the case 50 to define an L-shaped zipper opening. Opening the zipper 58 enables exposure of a flexible mesh panel 70 which connects with side edge 64 of panel 56 and bottom edge 58 of the case 50. In this manner an expanded pocket is formed in the side of the case 50 for holding, for example, a cell phone 72.

The top side of the panel 56, namely top side 74, as well as top side 76 of mesh panel 70, form a continuous enclosure for the cell phone 72. The top side 76 of the panel 70 comprises a ribbon of material, and preferably an elastomeric ribbon, which facilitates maintaining of the cell phone 72 or any other item within the described pocket. The mesh panel 70 also may be made from an elastomeric material. Thus, in the embodiment of FIGS. 2 and 3, a single solid panel 56 is combined with a mesh panel 70 and a ribbon 76 which is preferably elastomeric. This is contrasted with the embodiment of FIG. 1 wherein two parallel side panels 20 and 28 are provided.

FIGS. 4 through 6 illustrate a further embodiment of a pocket which may be incorporated as a means for storage of items external of a carrying case or item of luggage yet which may be conveniently stored within a pouch or as part of a pouch integrated into a side panel of luggage. Thus referring to those figures, an item of luggage 80 includes a side panel 82 with a zippered flap 84 forming a part of the side panel 82. The zippered flap 84 includes a pouch 86 to which access is provided via a zipper 88. In the embodiment shown in FIG. 4, the zipper 88 has been moved to the full open position permitting accessing to the contents of the pouch 86.

Within the pouch 86 is a strap or loop 90 which is stitched to the inside wall of the pouch. The strap or loop 90 fits through a ring 92 that is connected to a second loop or a strap 94 thereby forming a connection between the inside of the pouch 86 and a container or pocket 96 which is suspended on the loop or strap 94. The pocket or container 96 has an open top side 98 and is in the form of a cylinder. A peripheral passage 100 is provided around the top open mouth of the pocket 96 and a tie string or loop 102 is fitted through the passage or channel 100. The tie string 102 may be shortened to gather the top or opening 98 about the contents of the pocket 96. A string slide 104 is provided for cinching or holding the string or cord 102 tightly about an item or for closing the opening 98.

The pouch 96 is made from a flexible fabric material so that the pouch 96 may be fully folded and placed within the opening in the pouch 86 through the zipper opening 88. Thus the pouch 96 may be folded and stored within the pouch 86. Alternatively, it may be removed as shown in FIGS. 4 and 5.

The position of the strap 90 within the zippered opening 88 is preferably adjacent the closure end of the zipper 88. In this manner, the zipper opening or zipper 88 may be substantially closed to retain contents within the pouch 86 while the pocket 96 is retained and exposed on the outer side of the case 80. This is illustrated, for example, in FIG. 5

It should be noted that the ring connector 92 ensures that the pocket 96 will remain oriented in a vertical manner regardless of the orientation of the case 80. Thus, as shown in FIG. 5, in the event the case 80 includes a telescopic handle and wheels, used to facilitate transport of the luggage, the pouch 96 will remain vertically oriented, as will the contents thereof, as the case 80 is transported. This provides for improved access to the contents of the pocket 96 and also prevents items within the pocket from slipping or spilling from the pocket 96. This is considered to be an important feature of the construction of the invention.

Various alternatives to the described embodiment may be provided. The particular construction that the strap 90, 92, 94 as well as the pocket 96 may be varied. Mesh pockets with elastic openings may be provided in lieu of the pocket 96. Similarly, the arrangement of the mesh panels such as panel 70 and panel 56 may be altered. For example, multiple mesh panels may be utilized. Thus while there has been set forth preferred embodiments of the invention, it is to be understood that the invention is to be limited only by the following claims and equivalents thereof.

What is claimed is:

1. In a luggage item of the type having:

a side panel of flexible material, a lower side panel edge and generally parallel side panel side edges extending from the lower edge, the improvement comprising, in combination:

an open topped expansion pocket, said expansion pocket including a first flexible material panel attached to the side panel lower edge and one of said side panel side edges and having a fastener mechanism along an edge of said first material panel intermediate the side panel side edges;

a second flexible material panel having a substantially mirror image shape and size as the first flexible material panel, said second panel attached to the side panel lower edge and the remaining side panel side edge, said second panel also including a fastener mechanism connectable with the first panel mechanism to join the first and second panels together to form a pocket with an open top;

a mesh fabric panel connecting the first and second material panels by extending between the material panels on the inside of a pocket formed by the material panels; and a flexible ribbon member forming a connection between the top side of the first and second panels to limit the separation of the panels and also forming a top edge of the mesh panel.

2. The luggage item of claim 1 wherein the fastening mechanism comprises a zipper.

3. The luggage item of claim 1 wherein the ribbon member is elastomeric.

4. In a luggage item of the type having:

a side panel of flexible material, a lower side panel edge and generally parallel side panel side edges extending from the lower edge, the improvement comprising, in combination:

an open topped expansion pocket, said expansion pocket including a first flexible material panel attached to a side panel side edge and having a fastener mechanism along an edge of said first flexible material panel intermediate the side panel side edges;

a mesh fabric panel connecting the first flexible material panel by extending between the first flexible material panel and a side panel side edge; and a flexible ribbon member forming a connection between the top side of the first flexible material panel and said side panel side edge to limit the separation of the first flexible material panel and also forming a top edge of the mesh panel.

* * * * *